US010626882B2

(12) United States Patent
Nakatani

(10) Patent No.: US 10,626,882 B2
(45) Date of Patent: Apr. 21, 2020

(54) CENTRIFUGAL FAN

(71) Applicant: Rinnai Corporation, Aichi (JP)

(72) Inventor: Tatsuyoshi Nakatani, Aichi (JP)

(73) Assignee: Rinnai Corporation, Aichi (JP)

( * ) Notice: Subject to any disclaimer, the term of this patent is extended or adjusted under 35 U.S.C. 154(b) by 36 days.

(21) Appl. No.: 16/041,873

(22) Filed: Jul. 23, 2018

(65) Prior Publication Data

US 2019/0055957 A1 Feb. 21, 2019

(30) Foreign Application Priority Data

Aug. 21, 2017 (JP) ..... 2017-158351

(51) Int. Cl.

| | |
|---|---|
| ***F04D 17/16*** | (2006.01) |
| ***F04D 29/28*** | (2006.01) |
| ***F04D 29/051*** | (2006.01) |
| *F24H 9/18* | (2006.01) |
| *F23D 14/02* | (2006.01) |
| *F04D 25/06* | (2006.01) |

(52) U.S. Cl.

CPC ..... *F04D 29/281* (2013.01); *F04D 17/16* (2013.01); *F04D 29/051* (2013.01); *F04D 25/06* (2013.01); *F23D 14/02* (2013.01); *F24H 9/1836* (2013.01)

(58) Field of Classification Search

CPC ..... F04D 17/16; F04D 25/06; F04D 29/051; F04D 29/281; F24H 9/1836; F23D 14/02

USPC ..... 416/181

See application file for complete search history.

(56) References Cited

U.S. PATENT DOCUMENTS

| | | | | |
|---|---|---|---|---|
| 3,165,257 A * | 1/1965 | Edwards | F04D 29/664 415/200 |
| 3,414,188 A * | 12/1968 | Gallie | F04D 29/681 415/105 |
| 5,839,374 A * | 11/1998 | Conner | F04D 23/001 110/162 |
| 6,283,726 B1 * | 9/2001 | Fackelmann | F04D 25/082 415/58.4 |
| 7,066,712 B2 * | 6/2006 | Kim | F04D 17/165 415/58.4 |
| 7,086,837 B2 * | 8/2006 | Kamoshita | F04D 29/281 416/181 |

(Continued)

FOREIGN PATENT DOCUMENTS

| | | |
|---|---|---|
| JP | 2002-221192 A | 8/2002 |
| JP | 2015-230143 A | 12/2015 |

*Primary Examiner* — Igor Kershteyn

(74) *Attorney, Agent, or Firm* — Nakanishi IP Associates, LLC

(57) ABSTRACT

A centrifugal fan with an increased shutoff pressure maintains a negative pressure between a casing and a rotatable disk. The centrifugal fan includes an impeller including a rotatable disk and blades extending vertically from the rotatable disk and arranged radially about an axis of rotation of the rotatable disk toward a rim of the disk, a casing accommodating the impeller and including a base plate at its end face nearer the rotatable disk, and a motor mounted on the base plate externally and including a shaft fixed at a center of the rotatable disk to rotate the impeller. The rotatable disk has reflux holes at positions between inner rims and outer rims of the blades in its radial direction. The reflux holes allow a gas to reflux from between the rotating disk and the base plate inside the impeller as the impeller rotates.

4 Claims, 7 Drawing Sheets

(56) References Cited

U.S. PATENT DOCUMENTS

| | | | | |
|---|---|---|---|---|
| 7,374,394 | B2 * | 5/2008 | Lin | F04D 29/281<br>415/58.4 |
| 7,614,250 | B2 * | 11/2009 | Sanagi | F04D 25/082<br>62/426 |
| 8,753,077 | B2 * | 6/2014 | Gupta | H02K 5/10<br>310/54 |
| 8,920,128 | B2 * | 12/2014 | Matwey | F01D 5/046<br>416/231 R |

* cited by examiner

CENTRIFUGAL FAN

BACKGROUND OF INVENTION

Field of the Invention

The present invention relates to a centrifugal fan for feeding air to, for example, a combustion apparatus.

Background Art

A known centrifugal fan is an air blower used in, for example, a combustion apparatus (e.g., Patent Literature 1). The centrifugal fan includes an impeller, a casing, and a motor. The impeller includes a rotatable disk, and multiple blades extending vertically from the rotatable disk and arranged radially about the axis of rotation of the rotatable disk toward the rim of the rotatable disk. The casing accommodates the impeller. The motor includes a shaft fixed at the center of the rotatable disk to rotate the impeller. The casing has a peripheral surface with a radius increasing from the axis of rotation of the impeller in the rotating direction of the impeller. The casing has an air blowing channel that extends tangentially from its one end having the greater radius at the peripheral surface. The casing has one end face nearer the rotatable disk in the direction of the axis of rotation, on which the motor is mounted externally. The casing has an inlet port open in its other end face opposite to the rotatable disk. When the motor is driven to rotate the impeller, the centrifugal force of the rotating impeller causes air to blow outward from the impeller, feeding the air drawn through the inlet port to, for example, a combustion apparatus connected to the air blowing channel.

In addition to air, fuel gas may be drawn through the inlet port, allowing the air to preliminary mix with the fuel gas inside the centrifugal fan, and feeding the mixture gas to the combustion apparatus (e.g., Patent Literature 2). This centrifugal fan has a supply duct connected to the inlet port of the casing. The air-fuel mixture is adjusted to a predetermined ratio (air-fuel ratio) upstream from the supply duct.

CITATION LIST

Patent Literature

Patent Literature 1: Japanese Patent Application Publication No. 2002-221192

Patent Literature 2: Japanese Patent Application Publication No. 2015-230143

However, the combustion apparatus to which the centrifugal fan is connected can have clogging in its combustion chamber in which the mixture gas is burned or in its exhaust duct through which the combustion exhaust gas passes. The clogging may be caused by, for example, aging corrosion or accumulation of dust or other matter in the combustion chamber and the duct or by strong wind blown onto the exhaust port through which the combustion exhaust gas is discharged. Such clogging disables the centrifugal fan from feeding the gas (the air or the mixture gas) to the combustion apparatus. The centrifugal fan may thus preferably be resistant to clogging (or specifically have a high shutoff pressure). As the centrifugal fan for feeding a mixture gas is clogged more severely, the centrifugal fan can have a higher pressure between the casing and the rotatable disk, possibly leaking the mixture gas along the shaft of the motor.

SUMMARY OF INVENTION

In response to the above issue, one or more aspects of the present invention are directed to a technique for increasing the shutoff pressure of a centrifugal fan and enabling the centrifugal fan to maintain a negative pressure between a casing and a rotatable disk even if the fan is clogged severely.

A centrifugal fan according to one or more aspects of the present invention has the structure described below. The centrifugal fan includes an impeller including a rotatable disk and a plurality of blades extending vertically from the rotatable disk and arranged radially about an axis of rotation of the rotatable disk from a rim of the rotatable disk, a casing accommodating the impeller, and a motor. The casing includes a base plate at a first end face thereof nearer the rotatable disk, a lid plate at a second end face thereof opposite to the base plate, and a peripheral wall surrounding an outer periphery of the impeller. The motor is mounted on the base plate of the casing externally, and includes a shaft fixed at a center of the rotatable disk to rotate the impeller. The casing has an inlet port that is open in the lid plate at a position inward from the plurality of blades, and an air blowing channel extending from the peripheral wall. The motor is driven to rotate the impeller to cause a gas to be drawn through the inlet port and to be fed to an apparatus connectable to the air blowing channel. The rotatable disk has a plurality of reflux holes at positions between inner rims and outer rims of the plurality of blades in a radial direction of the rotatable disk. The plurality of reflux holes allow the gas to reflux from between the rotating disk and the base plate inside the impeller as the impeller rotates.

In the centrifugal fan according to the above aspect, the plurality of reflux holes are at positions between the inner rims and the outer rims of the plurality of blades in the radial direction of the rotatable disk to allow the gas to reflux from between the rotatable disk and the base plate inside the impeller. This structure prevents the gas refluxing through the reflux holes from colliding against the influx of the gas through the inlet port, and thus allows more effective refluxing of the gas. When an apparatus connected to the air blowing channel is clogged to cause the centrifugal fan to feed less gas, the above structure can actively reflux and blow the gas between the rotatable disk and the base plate again from the impeller without the gas stagnant between the rotatable disk and the base plate. Thus, the centrifugal fan achieves a higher shutoff pressure than the structure without the reflux holes. When the apparatus is clogged to cause the gas to flow in between the rotatable disk and the base plate, the reflux holes allow refluxing of the gas through them to reduce the pressure increase between the rotatable disk and the base plate. The centrifugal fan can thus effectively maintain a negative pressure between the rotatable disk and the base plate when the apparatus is clogged.

In the centrifugal fan according to the above aspect, the plurality of reflux holes may be at positions nearer the inner rims than a middle point between the inner rims and the outer rims of the plurality of blades in the radial direction of the rotatable disk.

The rotating impeller tends to have a lower pressure (a higher negative pressure) at positions nearer the inner rims than the middle point of the blades than at positions nearer the outer rims from which the gas is blown out. Thus, the structure with the reflux holes at positions nearer the inner rims than the middle point of the blades can further accelerate refluxing of the gas than the structure with the reflux holes at positions nearer the outer rims.

DETAILED DESCRIPTION

Figure 1:
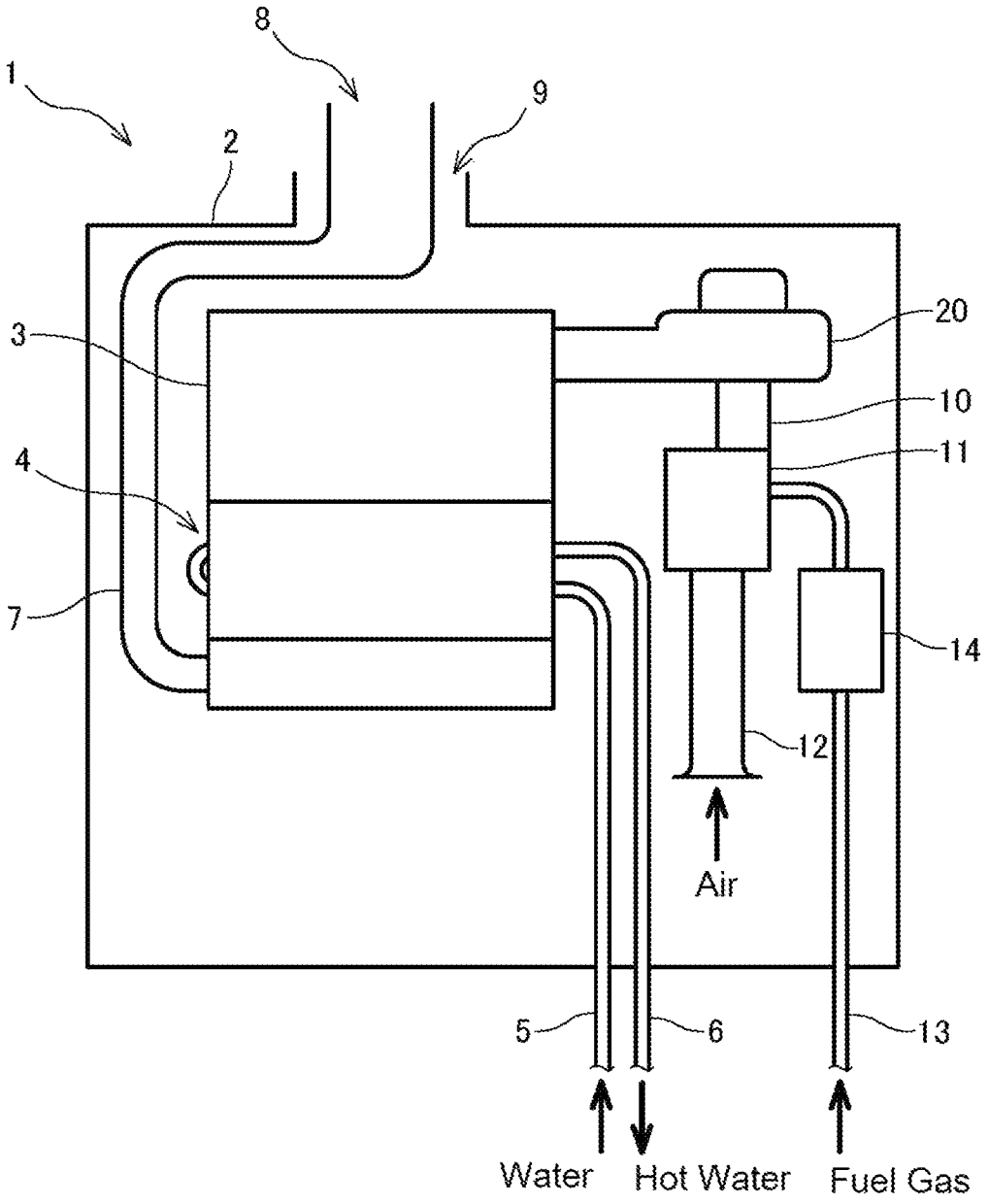
FIG. 1 is a schematic view of a water heater 1 as a combustion apparatus to which a centrifugal fan 20 according to one embodiment is connected.

FIG. 1 is a schematic view of a water heater 1 as a combustion apparatus to which a centrifugal fan 20 according to the present embodiment is connected. As shown in the figure, the water heater 1 includes a housing 2 accommodating a combustion unit 3, a heat exchanger 4 arranged below the combustion unit 3, and the centrifugal fan 20. The combustion unit 3 includes a built-in burner for burning a mixture gas of fuel gas and combustion air. The centrifugal fan 20 feeds the mixture gas to the combustion unit 3.

The centrifugal fan 20 has a supply duct 10 connected at its inlet port. The supply duct 10 has a joint 11 upstream, at which an air supply channel 12 for supplying combustion air and a gas supply channel 13 for supplying fuel gas meet. The joint 11 includes a built-in flow control valve for controlling the flow rate of combustion air and fuel gas flowing into the centrifugal fan 20. The gas supply channel 13 includes an open-close valve (not shown) for opening and closing the gas supply channel 13, and a zero governor 14 for lowering the pressure of fuel gas fed from upstream under pressure to the atmospheric pressure. When the centrifugal fan 20 is driven, the combustion air and the fuel gas are drawn into the centrifugal fan 20 through the supply duct 10, and the resultant mixture gas is then fed to the combustion unit 3. The structure of the centrifugal fan 20 according to the present embodiment will be described later with reference to other drawings.

In the combustion unit 3 connected to the outlet port of the centrifugal fan 20, the built-in burner (not shown) burns the mixture gas. In the illustrated example, the burner ejects the mixture gas downward, generating downward flames and feeding the combustion exhaust gas to the heat exchanger 4 downward. The heat exchanger 4 has one end to which a water supply channel 5 is connected, and the other end to which a hot water supply channel 6 is connected. The water supply channel 5 supplies clean water to the heat exchanger 4, in which the water is heated through heat exchange with the combustion exhaust gas from the burner, and flows out as hot water into the hot water supply channel 6.

The combustion exhaust gas that has passed through the heat exchanger 4 then travels along an exhaust duct 7, and is discharged through an exhaust port 8 protruding from the top of the housing 2. In the illustrated example, the exhaust port 8 is surrounded by an air supply port 9. The two ports form a double-tube structure. The air supply port 9 draws the combustion air into the housing 2. The combustion air is then drawn into the centrifugal fan 20 through the air supply channel 12.

Figure 2:
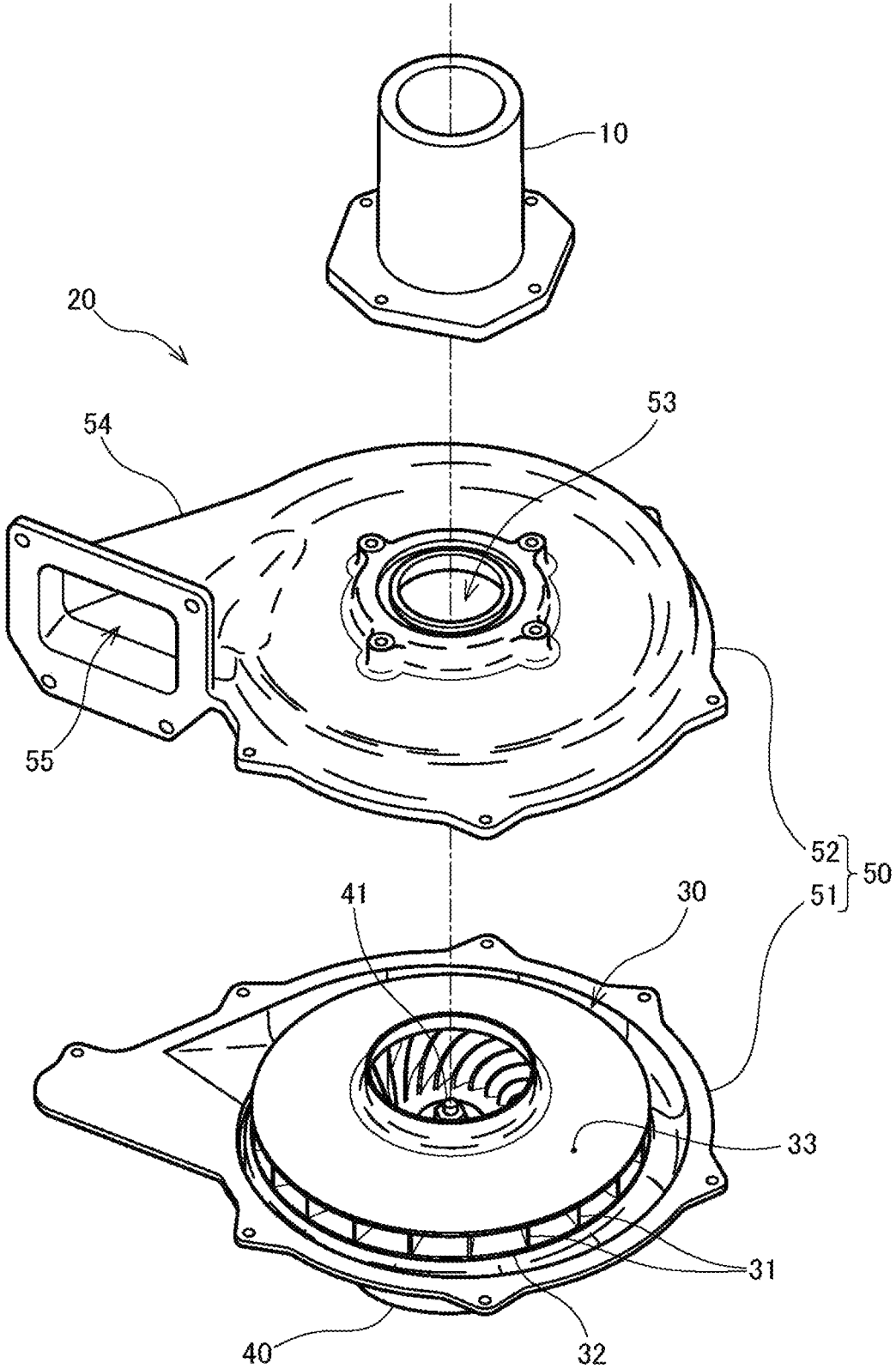
FIG. 2 is an exploded perspective view of the centrifugal fan 20 according to the embodiment.

FIG. 2 is an exploded perspective view of the centrifugal fan 20 according to the present embodiment. The centrifugal fan 20 in FIG. 2 is inverted upside down from the centrifugal fan 20 in FIG. 1. As shown in the figure, the centrifugal fan 20 includes an impeller 30 for generating wind by rotating, a motor 40 for rotating the impeller 30, and a casing 50 accommodating the impeller 30.

The impeller 30 includes a plurality of blades 31 (twenty one blades in the present embodiment) radially arranged at predetermined intervals about the shaft 41 of the motor 40, and is cylindrical. Each blade 31 is attached to a substantially circular rotatable disk 32 at its one end (the lower end in the figure) in the axial direction of the shaft 41, and to a ring-shaped support plate 33 at its other end (the upper end in the figure). The rotatable disk 32 is fixed to the shaft 41 of the motor 40 at its center. When the motor 40 is driven, the impeller 30 rotates about the shaft 41.

The casing 50 includes a body 51 with a recess, on which the motor 40 is mounted externally (on the lower surface in the figure), and a lid 52 with a recess facing the body 51. The body 51 and the lid 52 are joined together at their outer rims, and are fixed together with, for example, screws (not shown). The casing 50 has a peripheral wall with a radius increasingly from the shaft 41 in the rotating direction (counter-clockwise rotation in the figure) of the impeller 30. The casing has an air blowing channel 54 that extends tangentially from its one end having the greater radius at the peripheral surface. The air blowing channel 54 has an outlet port 55 at its end to which the combustion unit 3 is connected. The lid 52 further has an inlet port 53, which is open radially inward from the impeller 30. The supply duct 10 is connected to the inlet port 53, and is fixed to the lid 52 with, for example, screws (not shown).

Figure 3:
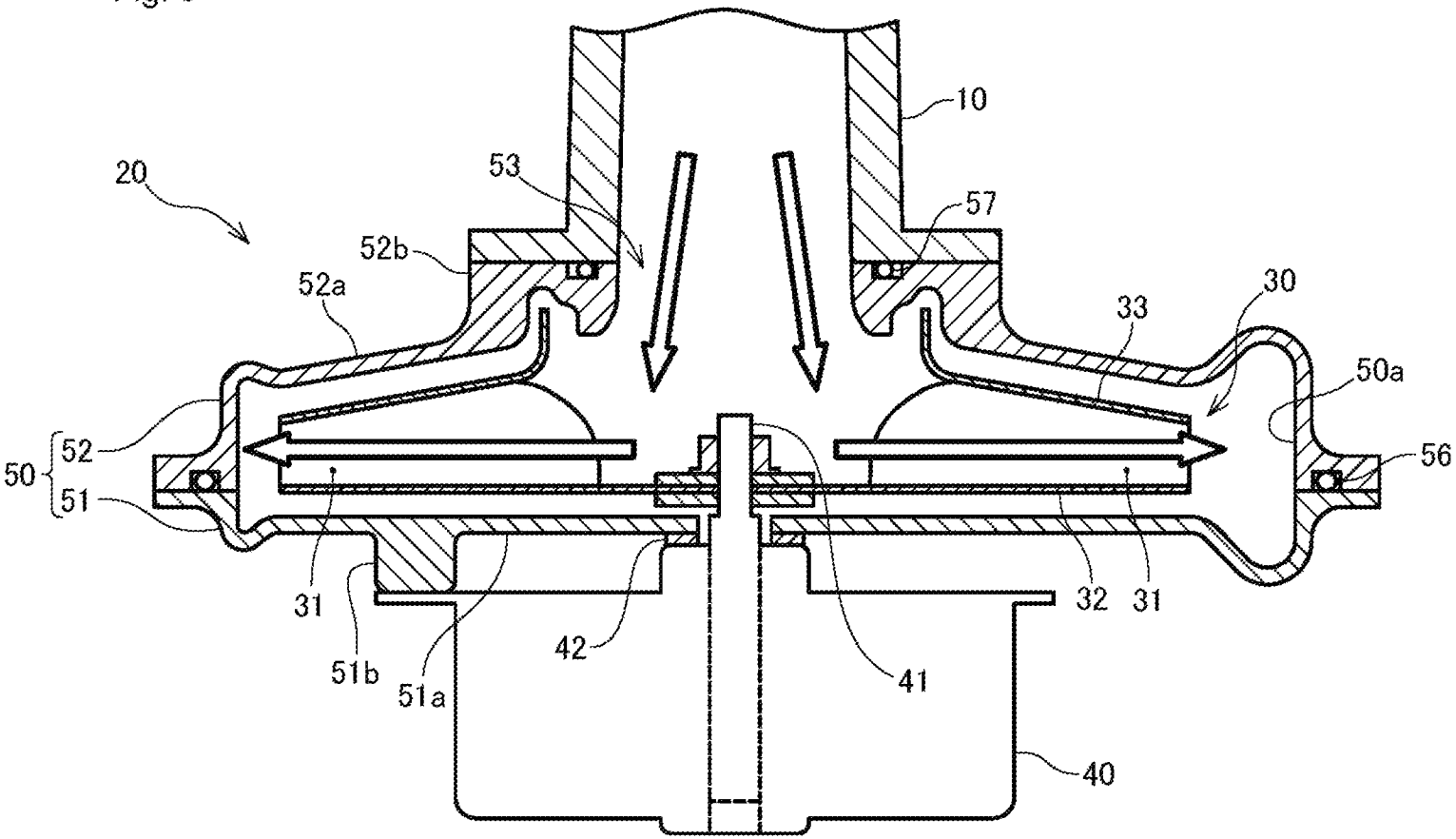
FIG. 3 is a cross-sectional view of the centrifugal fan 20 according to the embodiment taken along a plane containing a shaft 41 of a motor 40.

FIG. 3 is a cross-sectional view of the centrifugal fan 20 according to the present embodiment taken along a plane containing the shaft 41 of the motor 40. As described above, the casing 50 includes the body 51 and the lid 52 that are joined together. The casing 50 has an O-ring 56 placed between the body 51 and the lid 52 to maintain airtightness. The lid 52 includes a lid plate 52*a* facing the support plate 33 of the impeller 30. The lid plate 52*a* has a joint 52*b* to which the supply duct 10 is joined. An O-ring 57 is placed between the supply duct 10 and the joint 52*b* to maintain airtightness. The joint 52*b* has the open inlet port 53, which is located inward from the plurality of blades 31.

The body 51 of the casing 50 includes a base plate 51*a* facing the rotatable disk 32 of the impeller 30 with a plurality of (e.g., three) protrusions 51*b* protruding toward the motor 40 (downward in the figure), and the motor 40 is fixed to the protrusions 51*b* with, for example, screws (not shown). The shaft 41 penetrates the base plate 51*a*. A gasket 42 is placed between the motor 40 and the base plate 51*a* to maintain airtightness.

The motor 40 in the centrifugal fan 20 is commonly driven to rotate the impeller 30, which then generates a centrifugal force. The centrifugal force causes the mixture gas to flow radially outward along the plurality of blades 31 of the impeller 30. This causes the impeller 30 to have a negative pressure inside. The mixture gas from the supply duct 10 is thus drawn inside the impeller 30 through the inlet port 53. The thick arrows in the figure schematically indicate the flow of the mixture gas in the impeller 30. The mixture gas blown outward from the impeller 30 travels along a peripheral wall 50*a* of the casing 50 and through the air blowing channel 54 (refer to FIG. 2), and is then fed through the outlet port 55 to the combustion unit 3.

Figure 4A:
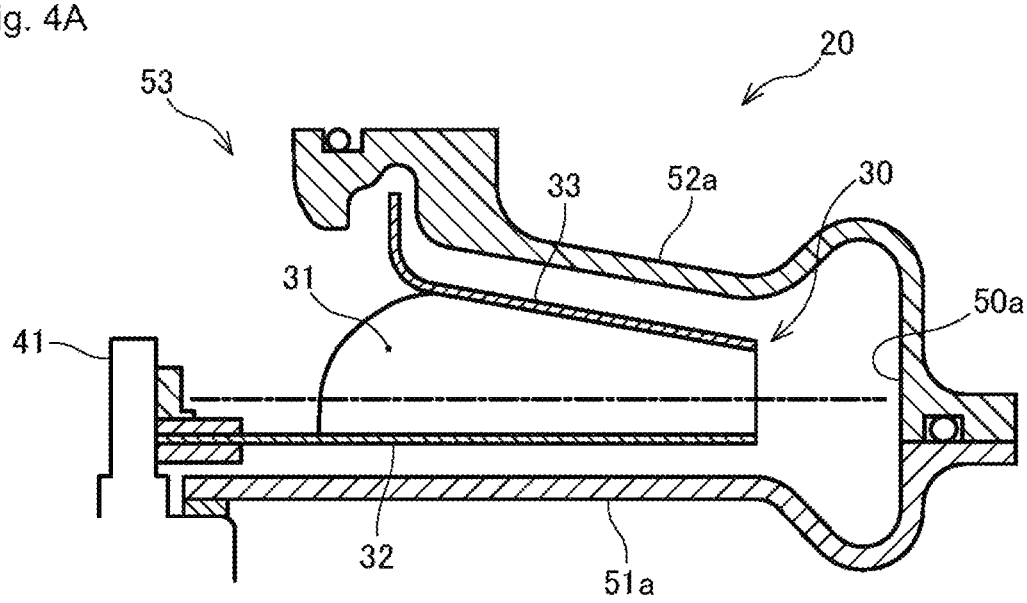
FIGS. 4A and 4B are diagrams describing the results of computer aided engineering (CAE) analysis of pressure distribution inside a rotating impeller 30.
Figure 4B:
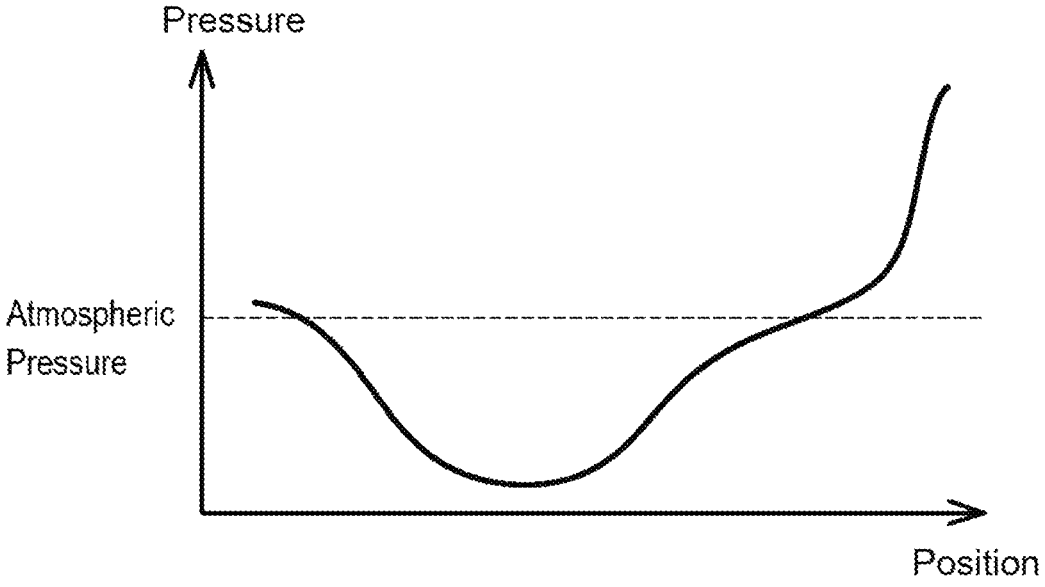

FIGS. 4A and 4B are diagrams describing the results of computer aided engineering (CAE) analysis of the pressure distribution inside the rotating impeller 30. FIG. 4A is an enlarged partial cross-sectional view of the centrifugal fan 20 between the shaft 41 and the peripheral wall 50*a* of the casing 50 taken along a plane containing the shaft 41. FIG. 4B is a graph showing the pressure distribution on the dot-and-dash line in FIG. 4A along the surface of the rotatable disk 32 near the blades 31. The graph shows the pressure distribution relative to the positions in the radial direction.

As described above, when the impeller 30 rotates, the centrifugal force causes the mixture gas between the blades 31 to blow outward from the impeller 30. The blown mixture gas hits the peripheral wall 50*a* of the casing 50, increasing the pressure between the impeller 30 and the peripheral wall 50*a* to a positive pressure. As the mixture gas blows outward from the impeller 30, the pressure in the impeller 30 between the inner rims and the outer rims in the radial direction of the blades 31 decreases to a negative pressure. The blades 31 generate a lower pressure (a higher negative pressure) at positions nearer their inner rims than their outer rims, from which the mixture gas is blown out. The positions are particularly nearer the inner rims of the blades 31 than the middle point between the inner rims and the outer rims of the blades 31. The impeller 30 has a higher pressure (a lower negative pressure) at positions more inward (near the center inward from the inner rims of the blades 31) than between the blades 31. This is caused by the mixture gas entering from the supply duct 10 through the inlet port 53 to hit the rotatable disk 32.

The water heater 1 (refer to FIG. 1) to which the above centrifugal fan 20 is connected can have clogging in the combustion unit 3 or in the exhaust duct 7 caused by, for example, aging corrosion or accumulation of dust or other matter in the combustion unit 3 and the exhaust duct 7 or by strong wind blown onto the exhaust port 8. When the pressure inside the combustion unit 3 increases due to such clogging, the centrifugal fan 20 may not easily feed the mixture gas under pressure to the combustion unit 3. The centrifugal fan 20 may thus preferably be resistant to clogging (specifically have a high shutoff pressure). As the water heater 1 is clogged more severely, the water heater 1 can have a higher pressure between the impeller 30 and the peripheral wall 50*a* in the centrifugal fan 20, possibly leaking the mixture gas between the rotatable disk 32 and the base plate 51*a* and causing a positive pressure between the rotatable disk 32 and the base plate 51*a*. As described above, although the airtightness between the motor 40 and the base plate 51*a* is maintained with the gasket 42, the airtightness cannot be maintained around the shaft 41 of the rotating motor 40 in a reliable manner. When the pressure between the rotatable disk 32 and the base plate 51*a* becomes positive, the mixture gas can leak along the shaft 41. The impeller 30 in the centrifugal fan 20 according to the present embodiment includes the rotatable disk 32 as described below to increase the shutoff pressure and maintain a negative pressure between the rotatable disk 32 and the base plate 51*a*.

Figure 5:
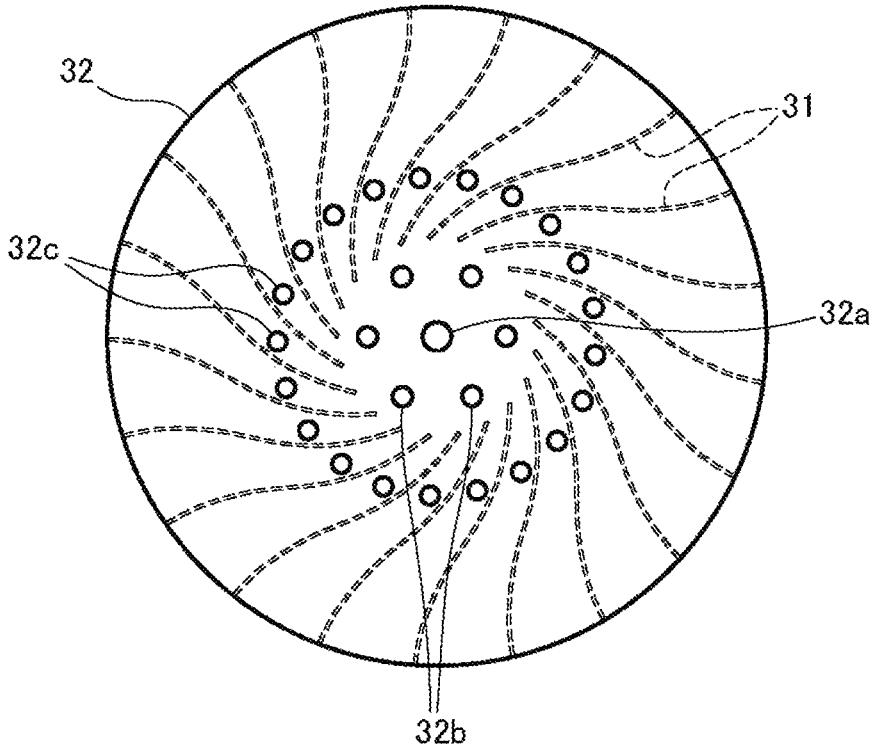
FIG. 5 is a plan view of a rotatable disk 32 according to the embodiment.

FIG. 5 is a plan view of the rotatable disk 32 according to the present embodiment. In the figure, the broken lines indicate the positions at which the blades 31 extend vertically from the rotatable disk 32. As shown in the figure, the rotatable disk 32 has a central through-hole 32*a*, through which the shaft 41 of the motor 40 is inserted. The rotatable disk 32 also has a plurality of first through-holes 32*b* near the center inward from the inner rims of the blades 31. In the illustrated example, the inner rims of the blades 31 are located on the circumference of a circle with a diameter of 40 mm and concentric with the rotatable disk 32 with a diameter of 140 mm. The first through-holes 32*b* (six holes) each with a diameter of 4.5 mm are located at equal intervals on the circumference of a circle with a diameter of 35 mm inside the circle that is defined by the inner rims of the blades 31.

The rotatable disk 32 further has a plurality of second through-holes 32*c* at positions between the inner rims and the outer rims of the blades 31. In the illustrated example, the second through-holes 32*c* each with a diameter of 4 mm are located on the circumference of a circle with a diameter of 70 mm and concentric with the rotatable disk 32. The second through-holes 32*c* are at positions nearer the inner rims than the middle point (on the circumference of a circle with a diameter of 90 mm) between the inner rims and the outer rims of the blades 31. Each second through-hole 32*c* is arranged between the adjacent blades 31. In correspondence with the number of blades 31 (twenty one blades), twenty one second through-holes 32*c* are provided in total. The second through-holes 32*c* according to the present embodiment correspond to the reflux holes in the claims.

Figure 6:
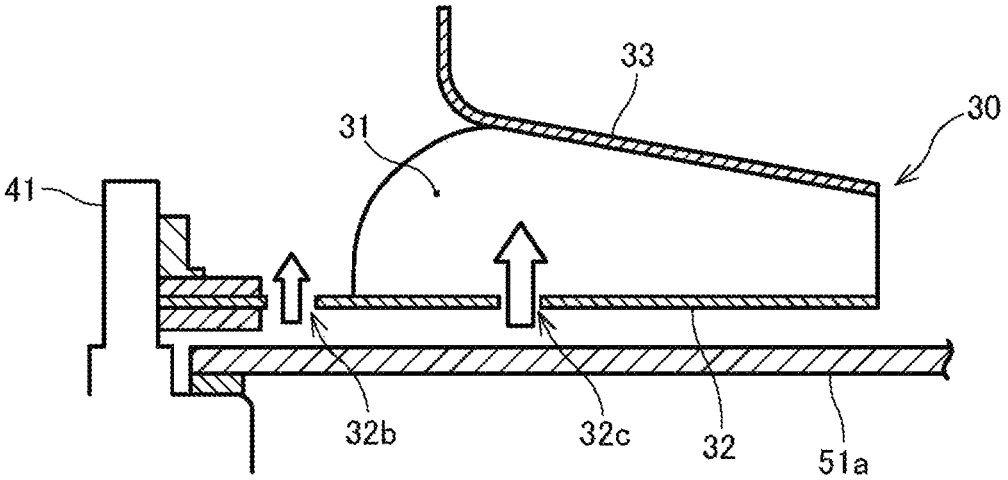
FIG. 6 is a diagram schematically describing a mixture gas flowing (refluxing) from between the rotatable disk 32 and a base plate 51*a* through a second through-hole 32*c* inside the impeller 30.

As described above, when the impeller 30 including the rotatable disk 32 rotates, the pressure between the blades 31 becomes negative, causing the mixture gas to flow (reflux) from between the rotatable disk 32 and the base plate 51*a* through the second through-holes 32*c* inside the impeller 30 (between the blades 31), as schematically indicated by the thick arrows in FIG. 6.

As the pressure inside the impeller 30 (near the center inward from the inner rims of the blades 31) becomes negative, the mixture gas also refluxes from between the rotatable disk 32 and the base plate 51*a* through the first through-holes 32*b* inside the impeller 30. However, as described above with reference to FIG. 4B, the impeller 30 has a higher pressure (a lower negative pressure) near the center than between the blades 31, and the reflux of the mixture gas through the first through-holes 32*b* collides against the influx of the mixture gas entering through the inlet port 53 (refer to FIG. 3). Thus, the first through-holes 32*b* less effectively reflux the mixture gas than the second through-holes 32*c*. As a result, the mixture gas almost exclusively refluxes through the second through-holes 32*c*. The first through-holes 32*b* are conventionally known structures, and often provided to reduce the resonance sound of the centrifugal fan 20 caused by the vibrating motor 40. However, in the present embodiment, to reflux the mixture gas more actively, the centrifugal fan 20 has the second through-holes 32*c*, in addition to or in place of the first through-holes 32*b* (e.g., FIGS. 5-6). The features of the centrifugal fan 20 according to the present embodiment will now be described, in comparison with a known centrifugal fan 20 including the rotatable disk 32 with the first through-holes 32*b* (six holes) and without the second through-holes 32*c*.

Figure 7:
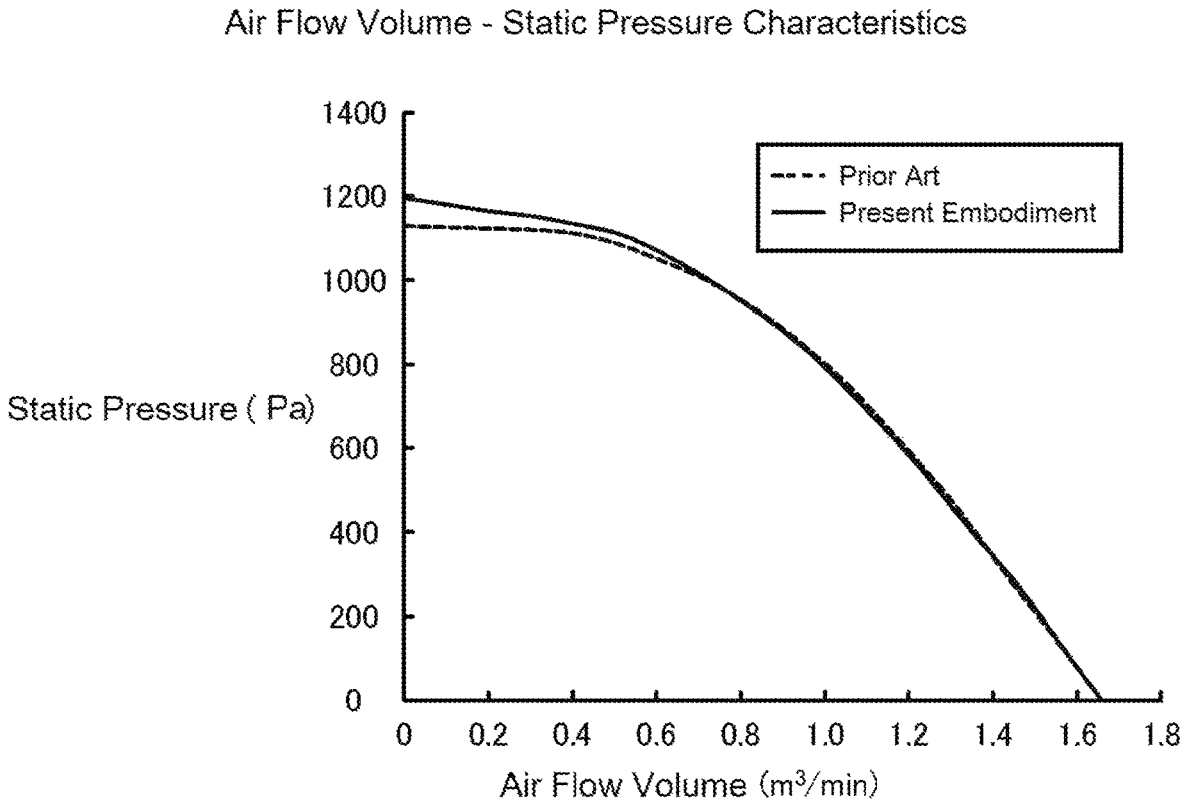
FIG. 7 is a graph of the air flow volume-static pressure characteristics showing the relationship between the air flow volume and the static pressure of the centrifugal fan 20.

FIG. 7 is a graph of the air flow volume-static pressure characteristics showing the relationship between the air flow volume and the static pressure of the centrifugal fan 20. In the graph, the dotted line indicates the air flow volume-static pressure characteristics of the known centrifugal fan 20, whereas the solid line indicates the air flow volume-static pressure characteristics of the centrifugal fan 20 according to the present embodiment. As shown in the graph, the centrifugal fan 20 according to the present embodiment has a higher static pressure than the known centrifugal fan 20 in the range with an air flow volume of 0.4 $m^3$/min or less. Although the centrifugal fans 20 are rotated at a rotational speed of 330 Hz in the illustrated examples, the same tendency is also observed at different rotational speeds.

As described above, the rotatable disk 32 according to the present embodiment has a higher negative pressure at the second through-holes 32*c* (between the blades 31) than at the first through-holes 32*b* (inward from the impeller 30). Further, the reflux of the mixture gas through the second through-holes 32*c* does not collide against the influx of the mixture gas entering through the inlet port 53. The second through-holes 32*c* thus more effectively reflux the mixture gas than the first through-holes 32*b*. In particular, as the pressure between the impeller 30 of the centrifugal fan 20 and the peripheral wall 50*a* increases, the mixture gas flows in between the rotatable disk 32 and the base plate 51*a*. This increases the pressure between the rotatable disk 32 and the base plate 51*a*, and further increases the reflux of the mixture gas through the second through-holes 32*c*. Thus, the centrifugal fan 20 according to the present embodiment with the second through-holes 32*c* in the rotatable disk 32 actively refluxes the mixture gas and blows the gas outward from the impeller 30 again without the gas stagnant between the rotatable disk 32 and the base plate 51*a*. Thus, the centrifugal fan 20 according to the present embodiment can have a higher shutoff pressure than the known centrifugal fans 20 without the second through-holes 32*c*.

The water heater 1 according to the present embodiment is designed to feed the mixture gas to the combustion unit 3 at an air flow volume of around 1.0 $m^3$/min in normal operation (without clogging). Although having the second through-holes 32*c* in the rotatable disk 32, the centrifugal fan 20 according to the present embodiment has substantially the same static pressure as the known centrifugal fan 20 without the second through-holes 32*c* at an air flow volume of around 1.0 $m^3$/min. In normal use of the centrifugal fan 20 according to the present embodiment, the second through-holes 32*c* in the rotatable disk 32 seem not to substantially affect the static pressure.

Figure 8:
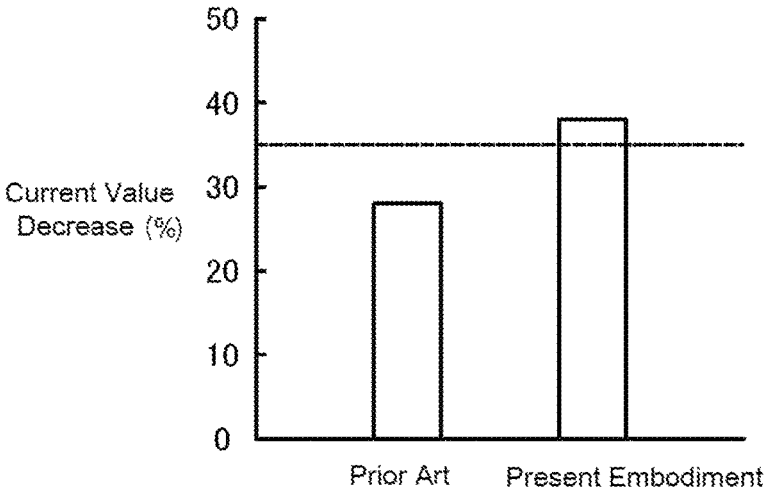
FIG. 8 is a graph showing the performance for maintaining a negative pressure between the rotatable disk 32 and the base plate 51*a* of the centrifugal fan 20 according to the embodiment in comparison with a known centrifugal fan 20.

FIG. 8 is a graph showing the performance for maintaining a negative pressure between the rotatable disk 32 and the base plate 51*a* (hereafter, negative pressure maintaining performance) of the centrifugal fan 20 according to the present embodiment in comparison with the known centrifugal fan 20. To evaluate the negative pressure maintaining performance of the centrifugal fan 20, the electric current value of the rotating motor 40 and the pressure between the rotatable disk 32 and the base plate 51*a* were measured in the water heater 1 clogged at varying degrees.

When the water heater 1 is clogged more severely, the centrifugal fan 20 can discharge less mixture gas. As the centrifugal fan 20 works less, the motor 40 is likely to have a smaller current value. The degree of clogging can be determined based on the decrease in the current value relative to its reference value (the current value without clogging). As the water heater 1 is clogged more severely and the centrifugal fan 20 discharges less mixture gas, the pressure between the impeller 30 and the peripheral wall 50*a* in the centrifugal fan 20 increases. This causes the mixture gas to flow in between the rotatable disk 32 and the base plate 51*a*, and increases the pressure between the rotatable disk 32 and the base plate 51*a*.

FIG. 8 shows the current value decrease of the motor 40 at a threshold (negative pressure maintaining threshold) at which the pressure between the rotatable disk 32 and the base plate 51*a* changes from negative to positive due to clogging. The known centrifugal fan 20 can maintain a negative pressure up to a current value decrease of 28%, whereas the centrifugal fan 20 according to the present embodiment can maintain a negative pressure up to a current value decrease of 38%.

As described above, the first through-holes 32*b* and the second through-holes 32*c* in the rotatable disk 32 draw (reflux) the mixture gas from between the rotatable disk 32 and the base plate 51*a* inside the impeller 30 as the pressure inside the rotating impeller 30 becomes negative. In normal operation (without clogging), the known centrifugal fan 20 and the centrifugal fan 20 according to the present embodiment both have a negative pressure between the rotatable disk 32 and the base plate 51*a*. The second through-holes 32*c*, which are at positions with a higher negative pressure inside the impeller 30 than the first through-holes 32*b*, allow more effective refluxing of the mixture gas. The centrifugal fan 20 according to the present embodiment including the rotatable disk 32 with the second through-holes 32*c* can thus achieve better negative pressure maintaining performance than the known centrifugal fan 20 without the second through-holes 32*c* when the water heater 1 is clogged.

The water heater 1 according to the present embodiment monitors the current value of the motor 40 during rotation. When the current value decrease reaches 35%, the water heater 1 forcibly stops combustion to avoid incomplete combustion due to clogging. In the known centrifugal fan 20, the pressure between the rotatable disk 32 and the base plate 51*a* may become positive before the current value decrease reaches 35%, possibly causing leakage of the mixture gas along the shaft 41. In contrast, the centrifugal fan 20 according to the present embodiment maintains a negative pressure between the rotatable disk 32 and the base plate 51*a* after the current value decrease reaches 35%, and forcibly stops operating before the pressure becomes positive. This structure prevents leakage of the mixture gas along the shaft 41.

Figure 9A:
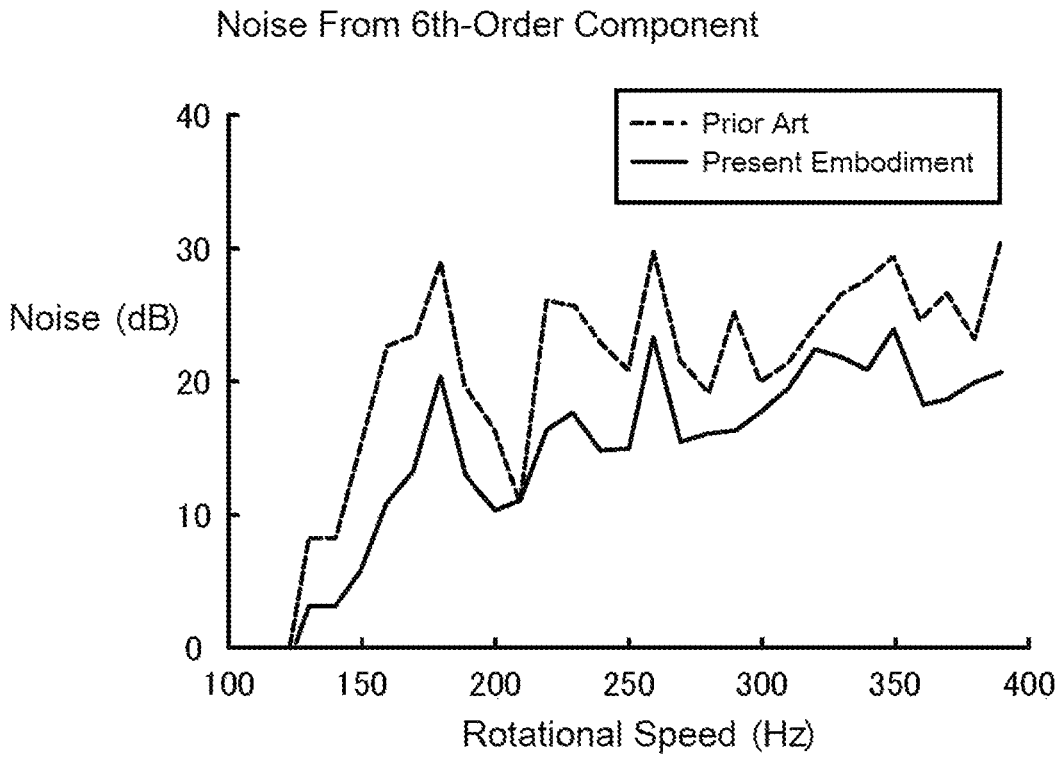
FIGS. 9A and 9B are graphs showing the measurement results of noise generated by the water heater 1 including the centrifugal fan 20 with the impeller 30 operated at varying rotational speeds.
Figure 9B:
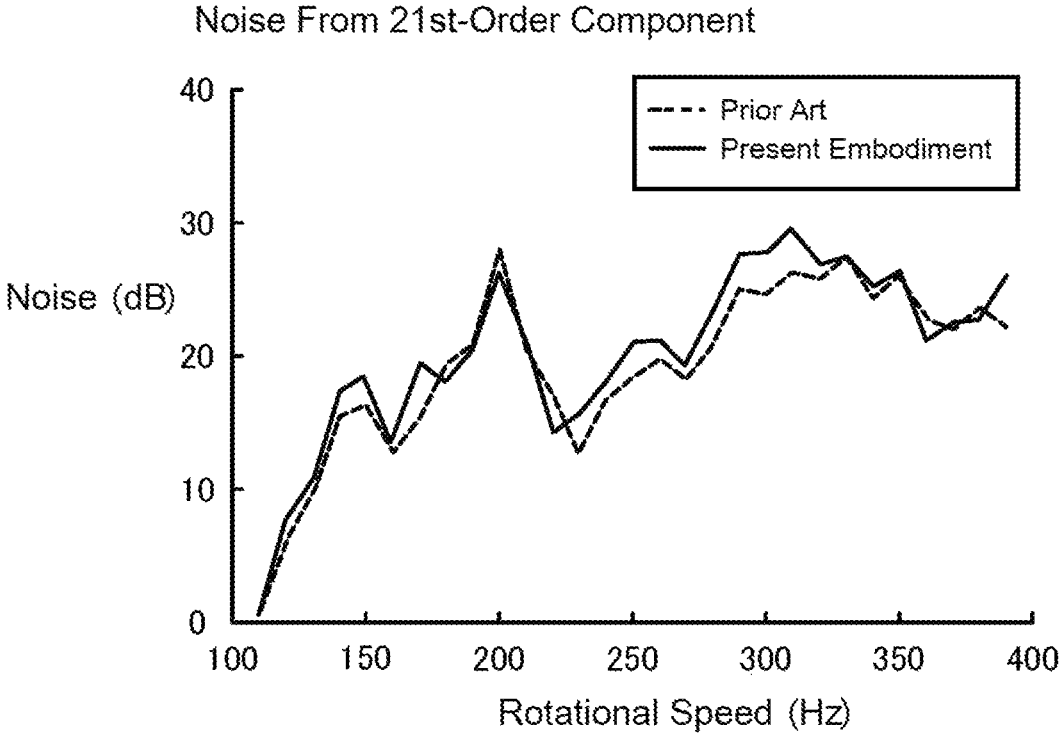

FIGS. 9A and 9B are graphs showing the measurement results of noise generated by the water heater 1 including the centrifugal fan 20 including the impeller 30 (the motor 40) operated at varying rotational speeds. In the graphs, the broken line indicates the results for the known centrifugal fan 20, whereas the solid line indicates the results for the centrifugal fan 20 according to the present embodiment. FIG. 9A shows the measurement results of noise from the sixth-order component (the frequency six times the rotation frequency). As described above, the known centrifugal fan 20 has the six first through-holes 32*b* in the rotatable disk 32. The reflux of the mixture gas through these first through-holes 32*b* collides against the influx of the mixture gas entering through the inlet port 53, and causes noise from the sixth-order component due to the resultant turbulence.

In contrast, the centrifugal fan 20 according to the present embodiment includes the rotatable disk 32 with the second through-holes 32*c*, through which the mixture gas is almost exclusively refluxed. Thus, the centrifugal fan 20 according to the present embodiment has less reflux of the mixture gas through the first through-holes 32*b* than the known centrifugal fan 20, and can prevent the reflux of the mixture gas from colliding against the influx of the mixture gas entering through the inlet port 53. This structure thus reduces noise from the sixth-order component caused by the resultant turbulence.

FIG. 9B shows the measurement results of noise from the 21st-order component (the frequency 21 times the rotation frequency). The centrifugal fan 20 according to the present embodiment has the twenty one second through-holes 32*c* in the rotatable disk 32. Although the mixture gas refluxes through the second through-holes 32*c*, the noise from the 21st-order component is substantially the same as in the known centrifugal fan 20 without the second through-holes 32*c*. The centrifugal fan 20 according to the present embodiment seems not to substantially affect noise caused by the second through-holes 32*c* in the rotatable disk 32.

As described above, the rotatable disk 32 in the centrifugal fan 20 according to the present embodiment has the plurality of second through-holes 32*c* at positions between the inner rims and the outer rims of the blades 31 in the radial direction of the rotatable disk 32, and allows the mixture gas to reflux from between the rotatable disk 32 and the base plate 51*a* through the second through-holes 32*c* inside the impeller 30. The second through-holes 32*c* allow the mixture gas to reflux without colliding against the influx of the mixture gas entering through the inlet port 53. The second through-holes 32*c* thus allow more effective refluxing than the first through-holes 32*b*, which are at positions near the center inward from the inner rims of the blades 31. When the water heater 1 is clogged and the centrifugal fan 20 feeds less mixture gas, the centrifugal fan 20 with the second through-holes 32*c* can actively reflux and blow the mixture gas outward from the impeller 30 again without the mixture gas stagnant between the rotatable disk 32 and the base plate 51*a*. Thus, the centrifugal fan 20 according to the present embodiment achieves a higher shutoff pressure than the centrifugal fan 20 without the second through-holes 32*c*. When the water heater 1 is clogged to cause the mixture gas to flow in between the rotatable disk 32 and the base plate 51*a*, the second through-holes 32*c* allow refluxing of the mixture gas through them to reduce the pressure increase between the rotatable disk 32 and the base plate 51*a*. The centrifugal fan 20 according to the present embodiment can thus achieve better negative pressure maintaining performance when the water heater 1 is clogged.

The centrifugal fan 20 according to the present embodiment with the second through-holes 32*c* in the rotatable disk 32 can reduce the mixture gas refluxing through the first through-holes 32*b*, and can prevent the mixture gas from colliding against the influx of the mixture gas entering through the inlet port 53. The reflux of the mixture gas through the second through-holes 32*c* does not collide against the influx of the mixture gas entering through the inlet port 53. This structure thus reduces noise, which can be caused by turbulence resulting from collision.

Although the centrifugal fan 20 according to the present embodiment has been described above, the embodiments disclosed herein should not be construed to be restrictive, but may be modified without departing from the scope and the spirit of the invention.

For example, the centrifugal fan 20 according to the above embodiment has the first through-holes 32*b* and the second through-holes 32*c* in the rotatable disk 32, with its features described in comparison with the known centrifugal fan 20 having the first through-holes 32*b* alone. In some embodiments, the centrifugal fan 20 may eliminate the first through-holes 32*b*. The centrifugal fan 20 according to the above embodiment eliminating the first through-holes 32*b* in the rotatable disk 32 (refer to FIG. 5) can also achieve a higher shutoff pressure and better negative pressure maintaining performance between the rotatable disk 32 and the base plate 51*a* upon clogging than the known centrifugal fan 20 without the first through-holes 32*b* or the second through-holes 32*c* in the rotatable disk 32. This is enabled by the reflux of the mixture gas through the second through-holes 32*c*

In the centrifugal fan 20 according to the above embodiment, the rotatable disk 32 has the plurality of second through-holes 32*c* in the rotatable disk 32 nearer the inner rims than the middle point between the inner rims and the outer rims in the radial direction of the blades 31. However, the second through-holes 32*c* may be at any positions between the inner rims and the outer rims of the blades 31 in the radial direction at which the rotating impeller 30 has a negative pressure. The second through-holes 32*c* may be at positions nearer the outer rims than the middle point of the blades 31. At positions nearer the outer rims than the middle point of the blades 31, the space between the adjacent blades 31 is greater than at positions nearer the inner rims (refer to FIG. 5). The second through-holes 32*c* can thus each have a larger diameter. However, the rotating impeller 30 tends to have a lower pressure (a higher negative pressure) at positions nearer the inner rims from the middle point than at positions near the outer rims of the blades 31, from which the mixture gas is blown out (refer to FIG. 4B). As in the embodiment described above, the structure with the second through-holes 32*c* at positions nearer the inner rims than the middle point of the blades 31 can further accelerate refluxing of the mixture gas than the structure with the second through-holes 32*c* located nearer the outer rims.

In the centrifugal fan 20 according to the above embodiment, the impeller 30 has twenty one blades 31. Each through-hole 32*c* is located between the adjacent blades 31. Thus, the twenty one second through-holes 32*c* in total are located between the blades in the rotatable disk 32. Each second through-hole 32*c* may not be located between every adjacent blades 31, but may be located between, for example, every other adjacent blades 31. In some embodiments, two or more second through-holes 32*c* may be radially spaced from one another between every adjacent blades 31.

In the centrifugal fan 20 according to the above embodiment, the inlet port 53 draws in the mixture gas of combustion air and fuel gas, and discharges the mixture gas through the outlet port 55 of the air blowing channel 54. However, the gas drawn in through the inlet port 53 may not be the mixture gas, and may be either combustion air or a fuel gas.

REFERENCE SIGNS LIST

1 water heater
2 housing
3 combustion unit
4 heat exchanger
5 water supply channel
6 hot water supply channel
7 exhaust duct
8 exhaust port
9 air supply port
10 supply duct
11 joint
12 air supply channel
13 gas supply channel
14 zero governor
20 centrifugal fan
30 impeller

31 blade
32 rotatable disk
32*a* through-hole
32*b* first through-hole
32*c* second through-hole
33 support plate
40 motor
41 shaft
42 gasket
50 casing
50*a* peripheral wall
51 body
51*a* base plate
51*b* protrusion
52 lid
52*a* lid plate
52*b* joint
53 inlet port
54 air blowing channel
55 outlet port
56 O-ring
57 O-ring

The invention claimed is:

1. A centrifugal fan, comprising:

an impeller including a rotatable disk, and a plurality of blades uprising vertically from the rotatable disk and arranged radially about an axis of rotation of the rotatable disk toward a rim of the rotatable disk;

a casing accommodating the impeller, the casing including a base plate at a first end face thereof nearer the rotatable disk, a lid plate at a second end face thereof opposite to the base plate, and a peripheral wall surrounding an outer periphery of the impeller; and a motor mounted on the base plate of the casing externally, the motor including a shaft fixed at a center of the rotatable disk, the motor being configured to rotate the impeller, wherein the casing has an inlet port that is open in the lid plate at a position inward from inner rims of the plurality of blades, and an air blowing channel extending from the peripheral wall, the motor is driven to rotate the impeller to cause a gas to be drawn through the inlet port and to be fed to an apparatus connectable to the air blowing channel, and the rotatable disk has a plurality of reflux holes at positions between the inner rims and outer rims of the plurality of blades in a radial direction of the rotatable disk, and the plurality of reflux holes allow the gas to reflux from between the rotating disk and the base plate inside the impeller as the impeller rotates.

2. The centrifugal fan according to claim 1, wherein the plurality of reflux holes are at positions nearer the inner rims than a middle point between the inner rims and the outer rims of the plurality of blades in the radial direction of the rotatable disk.

3. The centrifugal fan according to claim 1, wherein, each of the blades is arc-shaped over an entire part extending from the inner rims to an upper end of the blade.

4. The centrifugal fan according to claim 2, wherein, each of the blades is arc-shaped over an entire part extending from the inner rims to an upper end of the blade.

* * * * *